US011896869B2

(12) United States Patent
Elliott

(10) Patent No.: US 11,896,869 B2
(45) Date of Patent: Feb. 13, 2024

(54) EXERCISE APPARATUS

(71) Applicant: ALIGN-PILATES EQUIPMENT LTD, Evesham (GB)

(72) Inventor: David St John Elliott, Cheltenham (GB)

(73) Assignee: ALIGN-PILATES EQUIPMENT LTD, Evesham (GB)

( * ) Notice: Subject to any disclaimer, the term of this patent is extended or adjusted under 35 U.S.C. 154(b) by 0 days.

(21) Appl. No.: 17/089,283

(22) Filed: Nov. 4, 2020

(65) Prior Publication Data

US 2021/0128975 A1 May 6, 2021

(30) Foreign Application Priority Data

Nov. 4, 2019 (GB) ..... 1916039
May 18, 2020 (GB) ..... 2007364

(51) Int. Cl.
*A63B 22/20* (2006.01)
*A63B 21/02* (2006.01)
*A63B 21/04* (2006.01)

(52) U.S. Cl.
CPC ..... *A63B 22/203* (2013.01); *A63B 21/028* (2013.01); *A63B 21/0428* (2013.01)

(58) Field of Classification Search
CPC .. A63B 21/00058–00065; A63B 21/02; A63B 21/023; A63B 21/025;
(Continued)

(56) References Cited

U.S. PATENT DOCUMENTS 11,065,495 B1 * 7/2021 Savarino ..... A63B 21/023
2001/0056011 A1 * 12/2001 Endelman ..... A63B 22/0087 482/121

(Continued)

FOREIGN PATENT DOCUMENTS

EP 1774993 A2 4/2007
EP 1691899 B1 3/2010
WO WO-2012/125211 A1 9/2012

OTHER PUBLICATIONS

Great Britain Search Report for Application No. GB2017474.4, dated Apr. 30, 2021, (4 pages), Intellectual Property Office, South Wales, United Kingdom.

(Continued)

*Primary Examiner* — Joshua Lee
*Assistant Examiner* — Catrina A Letterman
(74) *Attorney, Agent, or Firm* — Alston & Bird LLP

(57) ABSTRACT

An exercise apparatus comprises a movable carriage having a generally flat top surface, the carriage being movably mounted on parallel track members of a frame having a head end and a foot end, the carriage having a pair of shoulder stops mounted thereto and plurality of elastic members connected between the foot end and the carriage to elastically bias the carriage toward the foot end of the frame. The apparatus has a movable spring anchor bar and carriage stop assembly comprising an anchor bar with at least one elongated stop member arranged perpendicular to and secured to the anchor bar, the stop member having a carriage stop surface located towards the end of the stop member remote from the anchor bar and the stop member further comprising at least one movable means of engagement with the frame of the exercise apparatus. The anchor bar and stop assembly may easily be moved and readjusted one handed with safety and smooth operation.

19 Claims, 14 Drawing Sheets

(58) Field of Classification Search
CPC ..... A63B 22/0076–2022/0084; A63B 22/20–203; A63B 21/028; A63B 21/0428; A63B 2208/0252; A63B 2208/0257; A63B 21/154; A63B 22/0087; A63B 23/03525; A63B 23/0405; A63B 21/00069; A63B 21/16; A63B 21/055
See application file for complete search history.

(56) References Cited

U.S. PATENT DOCUMENTS

| | | | | |
|---|---|---|---|---|
| 2005/0085357 | A1 | 4/2005 | Endelman | |
| 2005/0113226 | A1 | 5/2005 | Endelman et al. | |
| 2005/0113227 | A1* | 5/2005 | Endelman | A63B 22/0007 482/130 |
| 2008/0248935 | A1 | 10/2008 | Solow et al. | |
| 2010/0279834 | A1* | 11/2010 | Rooks | A63B 22/0087 482/142 |
| 2012/0283079 | A1* | 11/2012 | Solow | A63B 21/00065 482/142 |
| 2020/0222741 | A1* | 7/2020 | Aronson | A63B 21/151 |
| 2021/0106864 | A1* | 4/2021 | Duong | A63B 21/4035 |
| 2022/0249902 | A1* | 8/2022 | Endelman | A63B 21/4034 |

OTHER PUBLICATIONS

International Searching Authority, International Search Report for International Application No. PCT/EP2020/081011, dated Feb. 15, 2021, (11 pages), European Patent Office, Rijswijk, Netherlands.

* cited by examiner

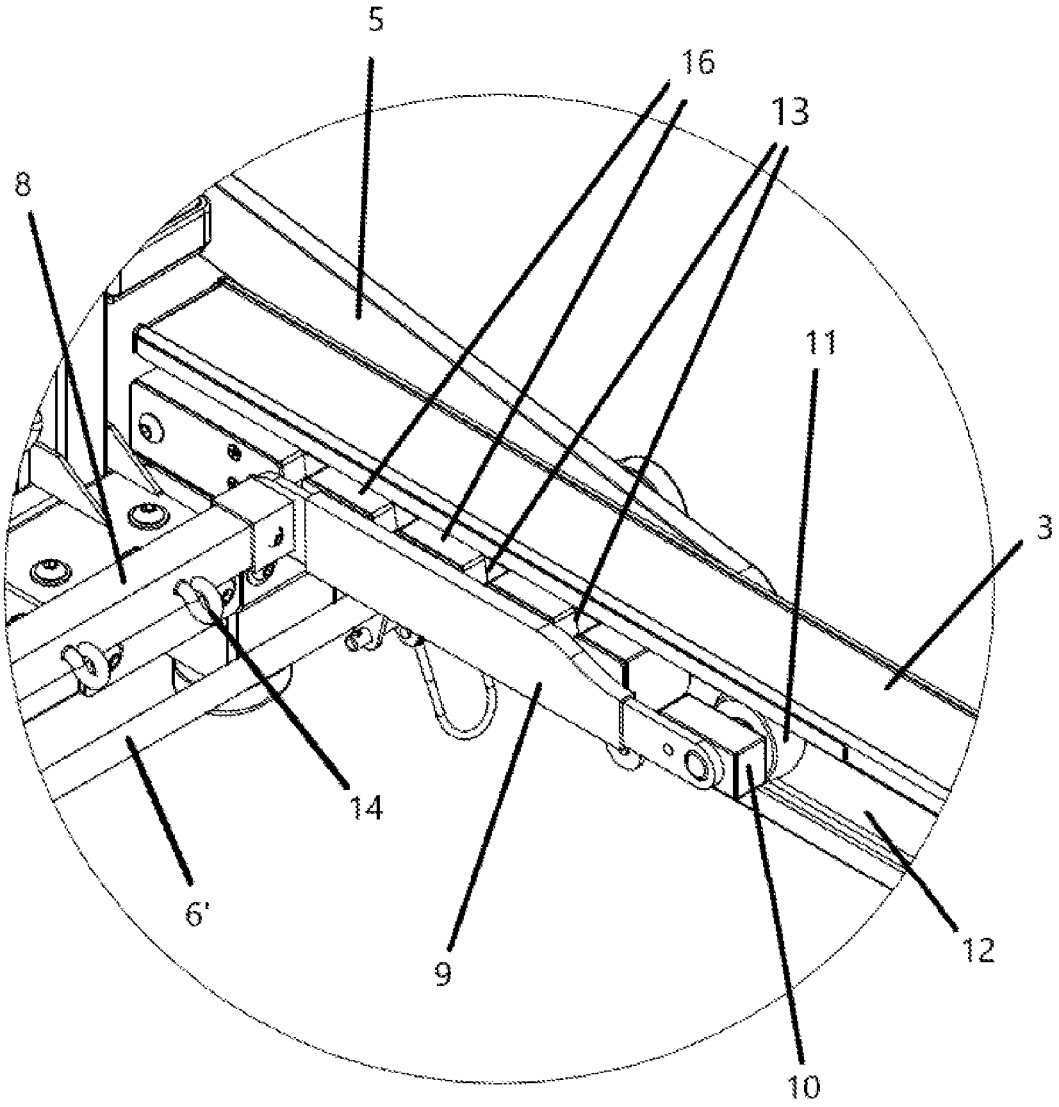
FIGURE 1 -A

EXERCISE APPARATUS

CROSS-REFERENCE TO RELATED APPLICATIONS

This application claims priority to and the benefit of both Great Britain Application No. GB1916039.9, filed Nov. 4, 2019 and Great Britain Application No. GB2007364.9, filed May 18, 2020; the contents of both of which as are hereby incorporated by reference herein in their entireties.

BACKGROUND

Related Field

This invention relates generally to the field of exercise APPARATUS commonly referred to as a reformer, in which a movable carriage is utilized to at least partially support a user's body and more particularly to carriage stop assemblies for such reformers.

RELATED ART

The Reformer Concept was Originally Developed by Joseph H. Pilates, and utilized a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. The generic form of exercise undertaken with these reformers is now referred to as Pilates. Since the original concept, which is almost 100 years old, many changes and improvements in the design of such exercise apparatus have been proposed.

The current conventional reformer includes a wheeled platform carriage which rides on or in a parallel rail system that is located upon or forms part of a rectangular wooden or metal frame. The carriage is connected to a series of parallel springs or elastic members, which are in turn connected in some form or other to the foot end of the rectangular frame. The carriage typically rides upon parallel rails or within tracks mounted to the inside of the sides of the rectangular frame. The sides of the frame are generally much longer than the frame ends. In most arrangements the carriage will include a pair of spaced, padded, upright shoulder stops and a head rest at one end to support the shoulders and head of the user when he/she is reclined on the carriage. In most modern arrangements there is an adjustable foot bar, foot support, or footrest against which the user places his/her feet or hands; this is mounted at or to the foot end of the rectangular frame. During operation the user is able to push against the footrest to move the carriage along the track and away from the footrest and this action is resisted by the spring tension; this resistance provides beneficial exercise to the leg and foot muscle groups in accordance with prescribed movement routines.

Most conventional reformers utilize a generally U-shaped foot bar, located at or on the foot end of the frame, that has a straight foot support portion between a pair of parallel legs that pivot in some fashion in relation to the sides of the frame. The foot bar is typically adjustable to desired heights and distances from the carriage. The positioning of the foot bar may be used to accommodate the varying heights of users of the apparatus. Another common feature is a spring anchor bar, which is positioned across the foot end of the frame and typically is secured at or to the foot end through the use of an anchor bar support bracket located on the end or either side of the frame. The ends of the anchor bar or sections of the anchor bar, in a typical arrangement, will sit within one of a number of recesses or slots in the anchor bar support bracket. These recesses are designed to offer a number of different locations and distances for the anchor bar in relation to the carriage. In addition the anchor bar will often have means to independently secure each spring to it and thus there are many different arrangements for different exercise resistance to suit users through spring tension (moderated by the distance of the anchor bar from the carriage) and the number and nature of the springs secured to the anchor bar and the carriage. Therefore, the size and/or ability and/or strength of the reformer user may be accommodated in many ways through foot bar, anchor bar and spring related adjustment. In alternative arrangements, the anchor bar may be permanently fastened to the frame. During use the carriage is typically prevented from moving close to the footrest and the anchor bar by means of a stop pin fastened to at least one of the side frames or associated tracks of the reformer; the carriage abuts these stop pins, when the carriage is at rest. In EP1774993, the conventional stop pin arrangement is replaced by a carriage stop surface that is located at a free end of an anchor bar arm, which is in turn fixed at its opposite end in a perpendicular fashion to the anchor bar. In this arrangement the anchor bar arm extends perpendicular from the front of the anchor bar and presents the carriage stop surface to the carriage. This arrangement has the benefit that the distance between the stop surface and anchor bar is maintained or fixed at each and every location of the anchor bar within the anchor bar support. This arrangement aids single hand adjustment of the anchor bar location without the need to relocate stop pins and/or remove springs. It has the severe disadvantage that it is difficult to execute for some users and for all users can be unsafe, especially when there are high spring loads on the anchor bar; when the spring bar is lifted too high the stop surface may be disengaged from contact with the carriage.

Accordingly, there is a need for a reformer type of exercise apparatus having an adjustable carriage and spring arrangement that is easy and safe for single hand operation by users.

BRIEF SUMMARY

The present invention addresses the above identified limitations in conventional reformer designs. The present invention is an exercise apparatus which comprises a preferably wheeled carriage having a generally flat top surface. The carriage is movably mounted on parallel track members of a generally rectangular frame which has a head end, a foot end and two side members. The carriage has a pair of shoulder stops mounted thereto and a head rest between the shoulder stops that extends outward from the carriage toward the head end of the frame. A plurality of elastic members connected between the foot end and the carriage elastically biases the carriage toward the foot end of the frame. A movable spring anchor bar with integrated carriage stop assembly is provided at the foot end of the rectangular frame preferably with an anchor bar support bracket and these work in unison to anchor the elastic members and position the carriage appropriately in relation to the anchor bar. Also, preferably present at the foot end of the frame is a footrest support mechanism.

The movable spring anchor bar and carriage stop assembly essentially comprises an anchor bar with at least one and preferably two elongated stop members that are arranged perpendicular to and secured to the anchor bar, each stop member having a carriage stop surface that is located towards an end of the stop member remote from the anchor bar and each stop member further comprising at least one movable means of engagement with the side members of the frame of the exercise apparatus and located proximate to the carriage stop surface. In this arrangement the elongated stop member extends perpendicular from the front of the anchor bar and the carriage stop surface is presented to the carriage. At the same time the movable means of engagement of the elongated stop member with the side members of the frame proximate to the carriage stop surface and to the stop member ensures that the elongated member and the anchor bar and carriage stop assembly is supported when the spring anchor bar is disengaged from the anchor bar support bracket for movement to another location on the anchor bar support bracket. This new arrangement associated with this assembly and the elongated stop members provides improved stability and smoothness of operation of the exercise apparatus during anchor bar relocation and is safer than previous arrangements. This new arrangement allows an anchor bar comprising any amount of springs attached to be removed and safely relocated on the exercise apparatus.

Thus, the present invention provides an exercise apparatus which comprises a movable carriage having a generally flat top surface, the carriage being movably mounted on parallel track members of the side members of the frame also having a head end and a foot end, the carriage having a pair of shoulder stops mounted thereto and plurality of elastic members connected between the foot end and the carriage to elastically bias the carriage toward the foot end of the frame, wherein the apparatus comprises a movable spring anchor bar and carriage stop assembly comprising an anchor bar with at least one elongated stop member arranged perpendicular to and secured to the anchor bar, the stop member having a carriage stop surface located towards the end of the stop member remote from the anchor bar and the stop member further comprising at least one movable means of engagement with the side members of the frame of the exercise apparatus located towards the stop surface end of the stop member.

Preferably, the exercise apparatus has an anchor bar and carriage stop assembly that comprises two elongated stop members.

In one embodiment the elongated stop members have carriage stop surfaces at their ends.

In one embodiment the elongated stop member comprises a separate stop surface member secured at its carriage end.

In one embodiment the stop surface member comprises an elastomeric or polymeric material or is metallic.

In one embodiment the stop surface members are located between the end of the elongated stop members and the movable means of engagement.

In one embodiment the movable means of engagement is a vertical orientated wheel riding within a c-section or square section runner located along the side of or within the side members of the frame. In a preferred embodiment the frame is a metallic c-section or square section frame.

In a further arrangement, the elongated stop members and/or the stop surface members may be arranged to be located within a hollow e.g. C section exercise frame.

The movable means of engagement may comprise shaped sections of low friction material that moves within a hollow section frame e.g. C or U or rectangular or square section. In these arrangements the movable means of engagement is secured to the elongated stop member via for example a pin or axle, which may pass through a slot in the side of the frame. The pin or axle may be secured to the low friction material through a bush bearing or similar arrangement.

The movable means of engagement is designed to provide rigidity between the elongated stop members and the side member of the frame and therefore are preferably designed and arranged to allow rotation of the elongated stop member about an axis between the means of engagement and the side members of the frame but to prevent any other movement between the side members of the frame and the elongated stop member other than parallel movement of one to the other. Thus, the elongated stop member may move parallel to the frame side members or rotate about the movable means of engagement on an axis perpendicular to the frame side members; other movements being prevented or severely restricted. Thus, during use the anchor bar is disengaged from the anchor bar support bracket and as the attached elongated member is moved during this detachment it rotates about the perpendicular axis at the point of movable engagement. As the anchor bar is then moved to a new location the anchor bar with the movable means of engagement are both moved relative to the frame side members and then as the anchor bar is placed in a new location the elongated stop member is able to rotate about the axis at the new location for the point of movable engagement to the same relative orientation with the frame side members before the anchor bar was moved.

It is preferred that the movable means of engagement is located at a point on the elongated stop member that allows sufficient rotation about its axis to allow the attached anchor bar to be disengaged from the anchor bar support bracket. If it is located too close to the anchor bar there will be insufficient capacity for rotation to disengage the anchor bar.

In a preferred embodiment, where the frame side member is a square section channel the movable means of engagement preferably comprises a vertical wheel and a combined horizontal wheel riding within a square section runner along the side of or within the frame side member.

In a further embodiment the end of the elongated stop member is located between the stop surface member and the movable means of engagement.

In a preferred embodiment the movable means of engagement is a pin and slot arrangement such as a that where the slot is comprised of a low friction material such as a low friction polymer slot on the frame side member into which it is engaged an axle or pin i.e. metal pin, protruding from the side of the elongated stop members. In a preferred embodiment the pin or axle is an integral part of the stop surface member. In a preferred embodiment the pin or axle section of the stop surface member passes through the elongated stop member to engage with the slot in the frame side members. The slot is preferably located in a metal plate or section that is attached to or within the frame side members of the exercise apparatus. It is preferred that the slot is manufactured from a low friction polymeric material and preferably a hard and low friction polymeric material. Preferred materials include polyoxymethylene (POM) based polymers, nylon materials and acetal homopolymers such as for example the Delrin® range of acetal homopolymers manufactured by DuPont.

In a typical arrangement the spring anchor bar is captured by a pair of spring anchor bar support brackets each having a plurality of bar receiving recesses therein. Each support bracket is fixed to the frame side members or frame end. The assembly may also include a latch mechanism, that can be operated with one hand, to removably secure the assembly to the spring anchor bar support brackets. One end of each of the stop members with their stop surface members acts as a carriage stop which properly maintains the minimum distance between the carriage and the anchor bar regardless of which recess in the support bracket carries the anchor bar. During operation once the anchor bar is removed from the anchor bar support bracket the movable means of engagement retains the assembly in a relatively set and rigid but movable spatial arrangement with the apparatus frame and this ensures easy and stable relocation of the assembly.

In an alternative arrangement the present invention provides an exercise apparatus which comprises a movable carriage having a generally flat top surface, the carriage being movably mounted on parallel track members of the frame side members having a head end and a foot end, the carriage having a pair of shoulder stops mounted thereto and plurality of elastic members connected between the foot end and the carriage to elastically bias the carriage toward the foot end of the frame side members, wherein the apparatus comprises a movable spring anchor bar and carriage stop assembly comprising an anchor bar and at least one elongated stop member arranged perpendicular to the anchor bar and pivotally secured to the carriage, the stop member having a stop surface located towards the end of the stop member remote from the carriage and the stop member further comprising at least one movable means of engagement with the frame side members of the exercise apparatus located towards the stop surface end of the stop member.

In this arrangement the stop member is pivotally mounted to the front of the carriage and is not part of or attached to the anchor bar. Under tension the stop surface of the stop member is removably contacted with the anchor bar to provide the carriage stop function during use. Preferably, the stop surfaces comprise a U or C shaped profile that may engage with and partially surround the anchor bar at the point of contact; this ensures that when the anchor bar is moved the stop members being engaged through this feature with the anchor bar move in unison with the anchor bar.

All embodiments of the present invention may also comprise a secondary locking mechanism to secure the anchor bar and or elongated stop member after they have been relocated in the apparatus.

Other objects, features and advantages of the present invention will become apparent from a reading of the following detailed description when taken in conjunction with the accompanying drawing wherein particular embodiments of the invention are disclosed as illustrative examples.

DETAILED DESCRIPTION OF VARIOUS EMBODIMENTS

Figure 1:
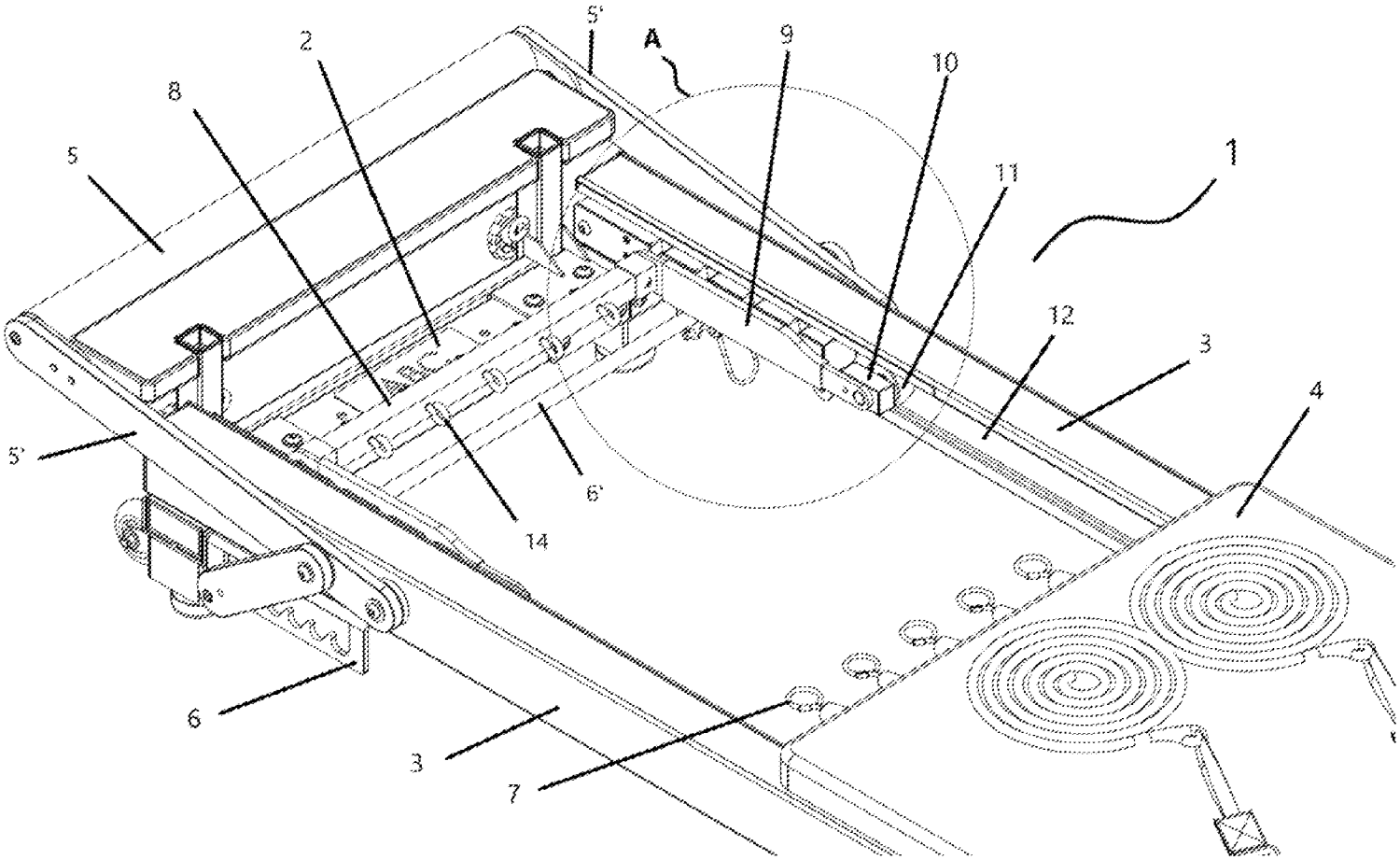
FIG. 1 is a perspective view of the foot end of an exercise apparatus in accordance with one embodiment of the present invention, FIG. 1-A is an exploded image of region A of FIG. 1.
Figure 2:
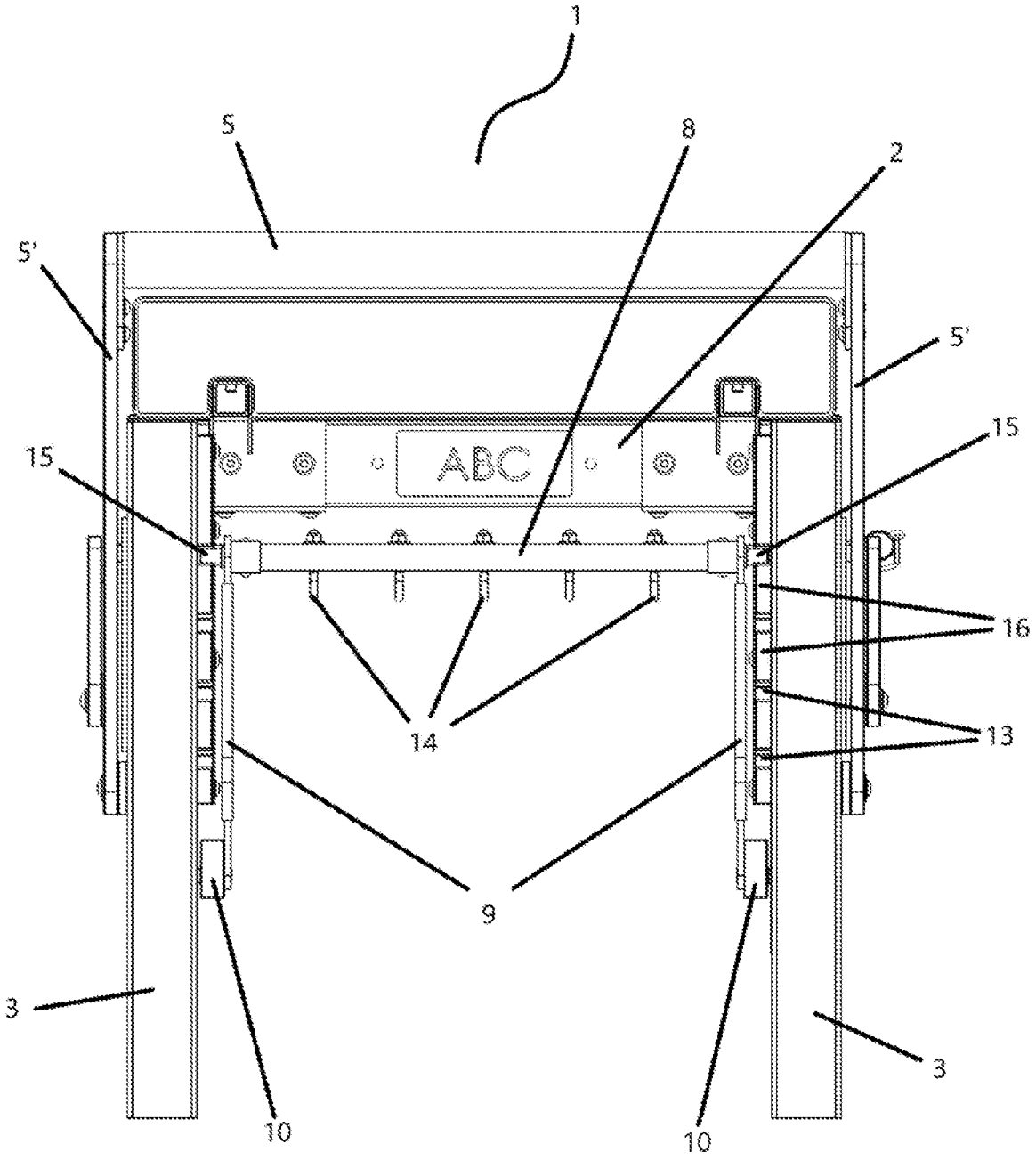
FIG. 2 is a top view of the exercise apparatus shown in FIG. 1.

With reference to FIGS. 1. 1-A and 2, the illustrated exercise apparatus (1) has a foot end (2), side frame (3) and carriage (4). Also illustrated is a foot bar assembly (5, 5', 6 and 6'), which is adjustable for different heights and distance from the carriage (4). The movable spring anchor bar is shown (8), which is of square cross-section with a number of anchor points (14) for the movable springs (7). Secured to either end of the movable spring anchor bar (8) are two elongated stop members (9), which extend from the movable spring anchor bar (8) towards the carriage (4) and are arranged generally parallel with the side frames (3). The movable spring anchor bar (8) comprises pins (15) at either end that engage with and are secured within slots (13) that are within an anchor bar support (16), which is secured to the side frame (3). At the ends of the elongated stop member (9) there is a stop surface member (10), which is located between the end of the elongated stop member (9) and a movable engagement means (11), which is securely engaged within a C-section profile (12) of the side frame (3). In this embodiment the movable means of engagement (11) takes the form of a wheel arrangement which has an axis perpendicular to the elongated stop member (9) and the frame (3) and which passes through the stop surface member (10) and the end of the elongated stop member (9). During use the movable spring anchor bar (8) and its pins (15) are removed from engagement within the slots (13) of the anchor bar support (16) and the whole assembly pivots about the axis through the wheel (11), which is securely located within the C-section (12). As the anchor bar (8) is moved towards the next slot (13) as anchor point in the anchor bar support (16) and towards the carriage (4) the wheel form movable engagement means (11) travels along and within the C-section and maintains the end of the elongated stop members (9) and stop surface members (10) in rigid alignment with the frame (3) about the pivot axis. The anchor bar (8) is raised upwards forcing the elongated stop member (9) to rotate upwards about the pivot axis of the wheel. Once the anchor bar (8) is aligned with the next slot (13) location in the anchor bar support (16) and it is placed in that slot (13) location the attached elongated stop member (9) will now rotate downwards about the pivot axis of the wheel and the whole assembly will be rigidly locked in position for use. During this movement because of the rigidity of the anchor bar (8) and the constrained but movable location of the movable engagement means (11) in relation to the anchor bar (8) the whole assembly retains its strength and rigidity through this movement, and this ensures smooth and safe operation.

Figure 3:
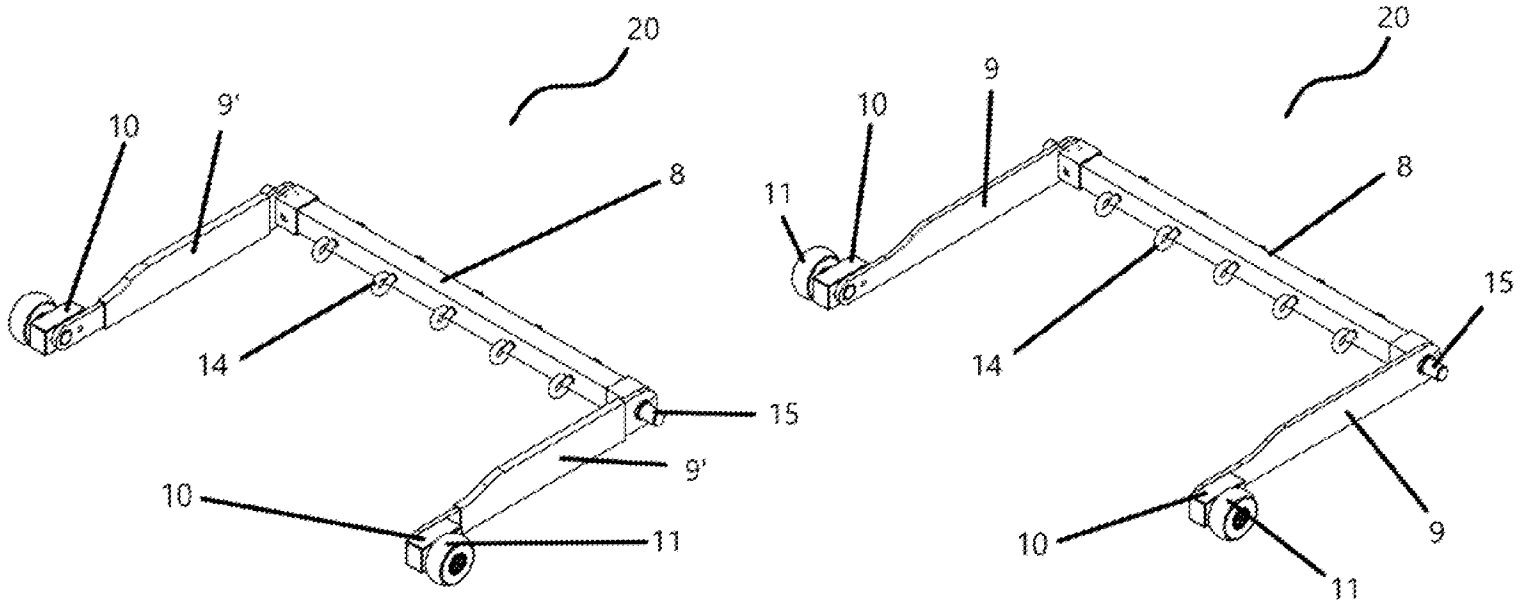
FIG. 3 is a perspective view of movable spring anchor bars and carriage stop assemblies of different size as used in the apparatus of FIG. 1.

With reference to FIG. 3, two similar anchor bar assemblies are shown (20) with an anchor bar (8) with pins (15) and anchor points (14). The assembly has elongated stop members (9 and 9') having stop surface members (10) and wheel means for movable engagement (11) at their ends. The elongated stop members (9 and 9') are of different length.

Figure 4:
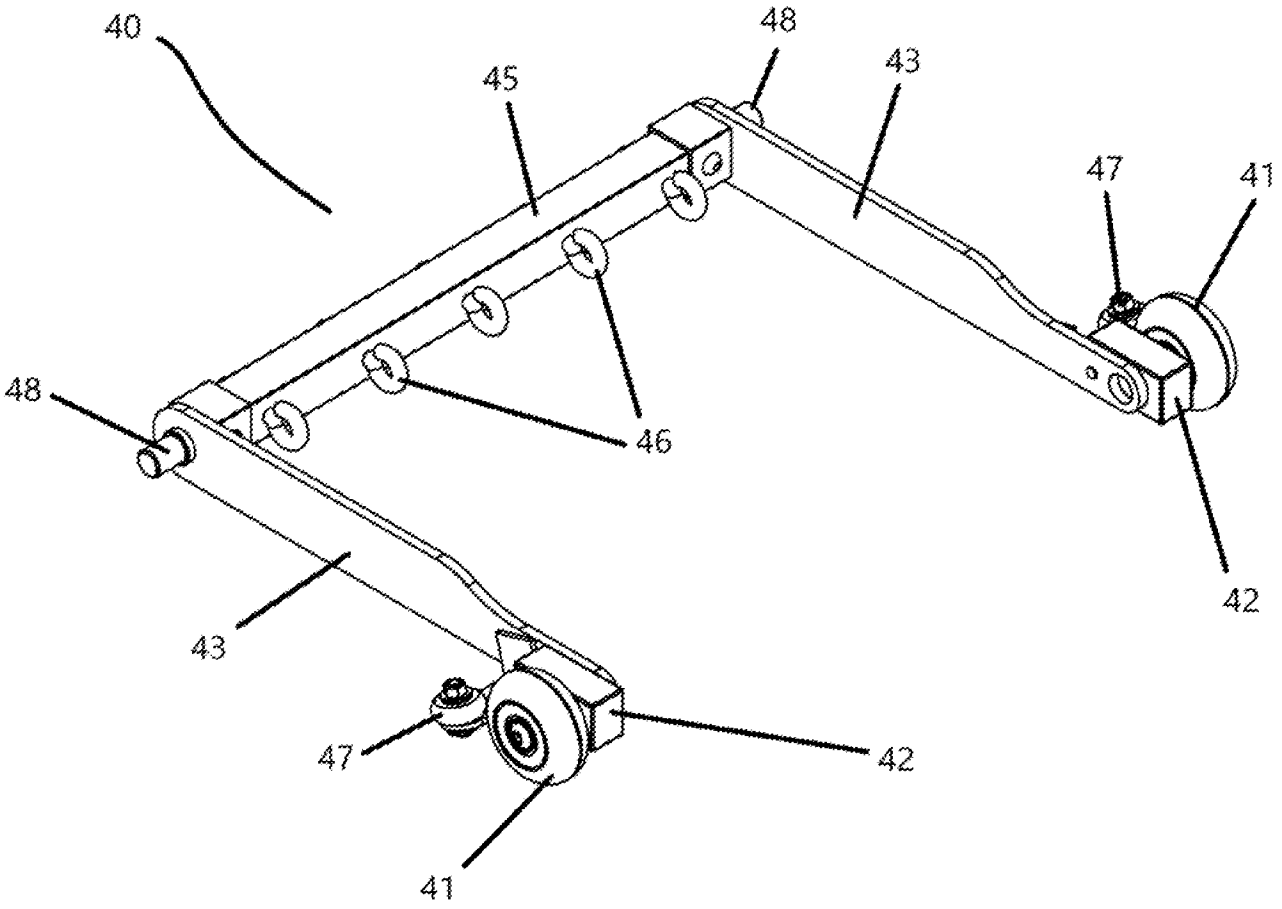
FIG. 4 is a perspective view of a movable spring anchor bar and carriage stop assembly in a further embodiment of the present invention.

With reference to FIG. 4, the anchor bar assembly (40) is designed for use with an exercise apparatus that has a square section profile side frame as an alternative to the C-section profile (12) of FIG. 1. The assembly (40) has an anchor bar (45) with anchor bar pins (48), spring anchor points (46) elongated stop members (43), stop surface members (42) and two-wheeled means for movable engagement (41 and 47). The larger wheel (41) and smaller wheel (47) mounted perpendicular to the larger wheel (41) co-operate to ensure proper alignment and travel of the assembly within a square section framed apparatus.

Figure 5:
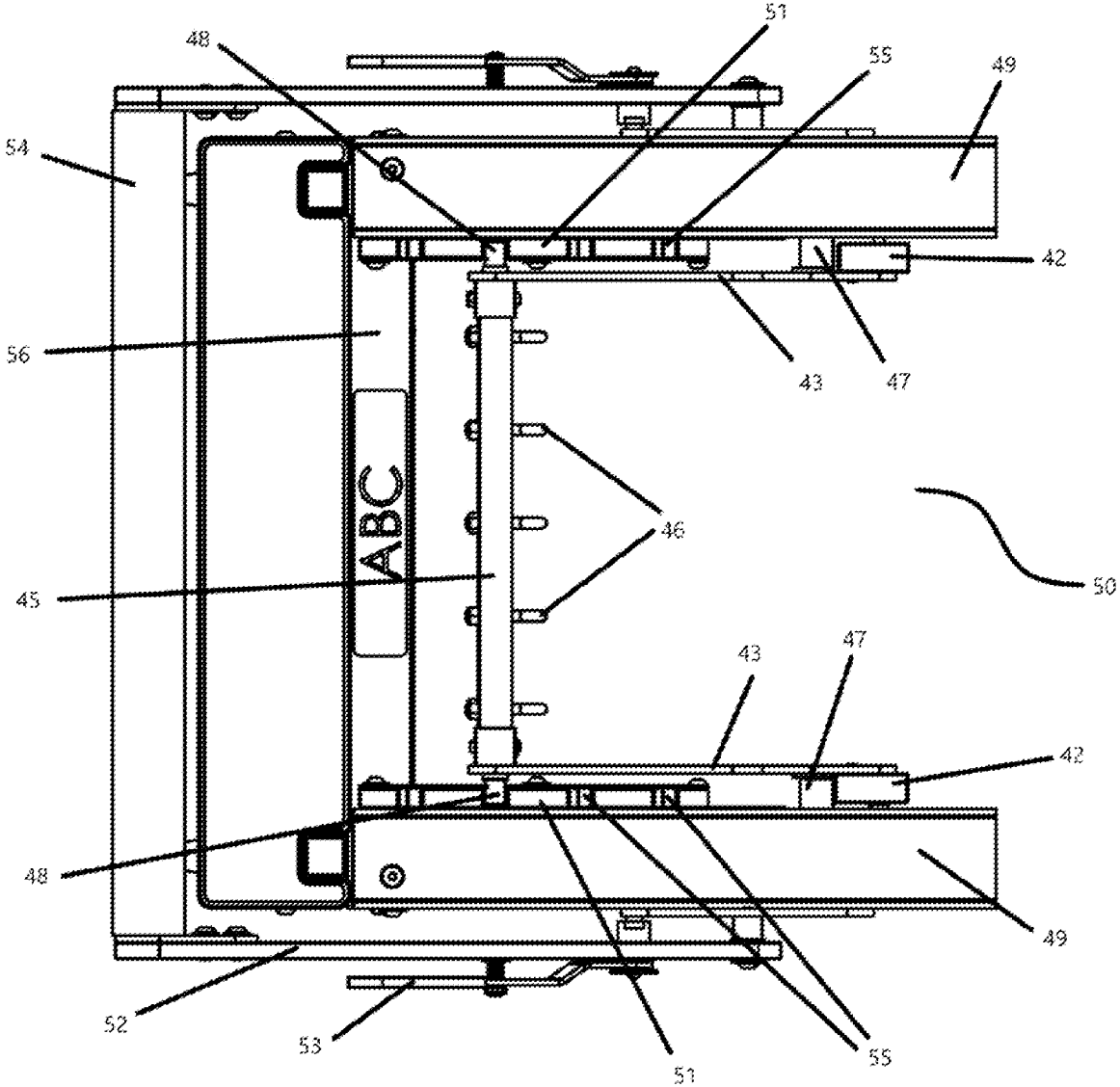
FIG. 5 is a top view of the foot end of an exercise apparatus in accordance with the further embodiment of the present invention incorporating the assembly of FIG. 4.

With reference to FIG. 5, the apparatus of FIG. 4 is shown in-situ in an exercise apparatus (50) having a frame end (56) and a side frame (49), which has a square section interior channel (not shown). Also shown is the anchor bar support member (51), which is secured to the side frame (49) and which has multiple slots (55) for engaging pin (48) of the anchor bar (45). Also illustrated is the foot bar assembly (52, 53 and 54).

Figure 6:
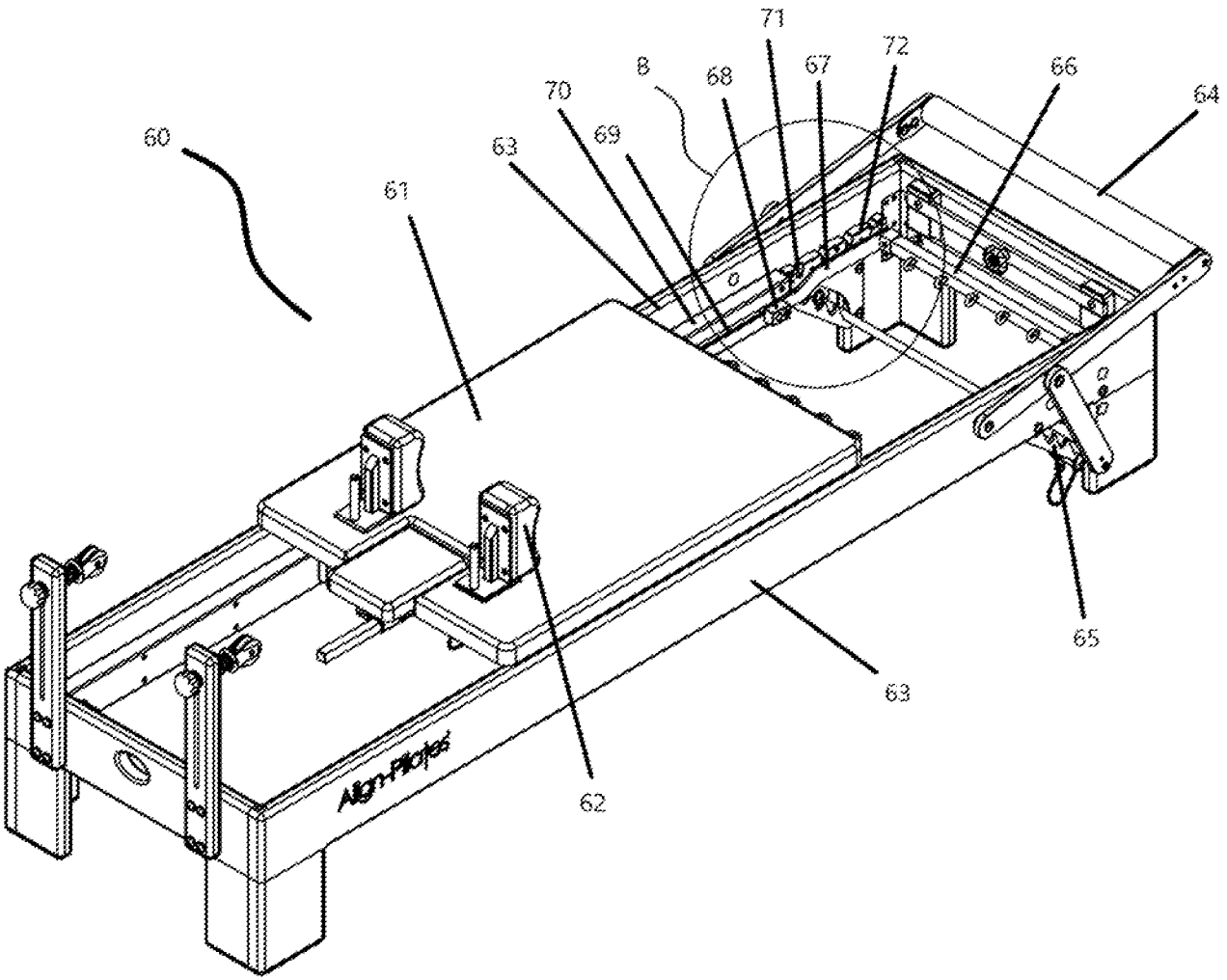
FIG. 6 is a perspective view of an exercise apparatus in accordance with the present invention using an axle and slot as the means for movable engagement, FIG. 6-B is an exploded image of region B of FIG. 6.
Figure 6B:
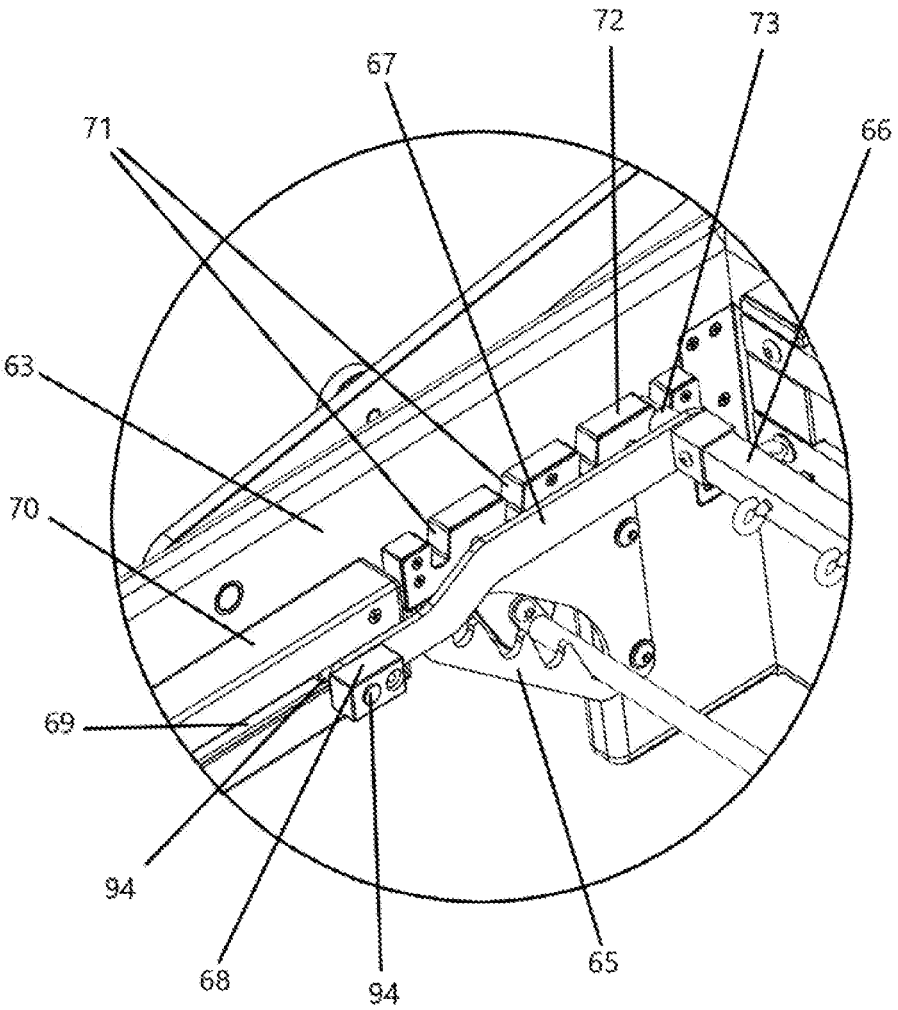
Figure 7:
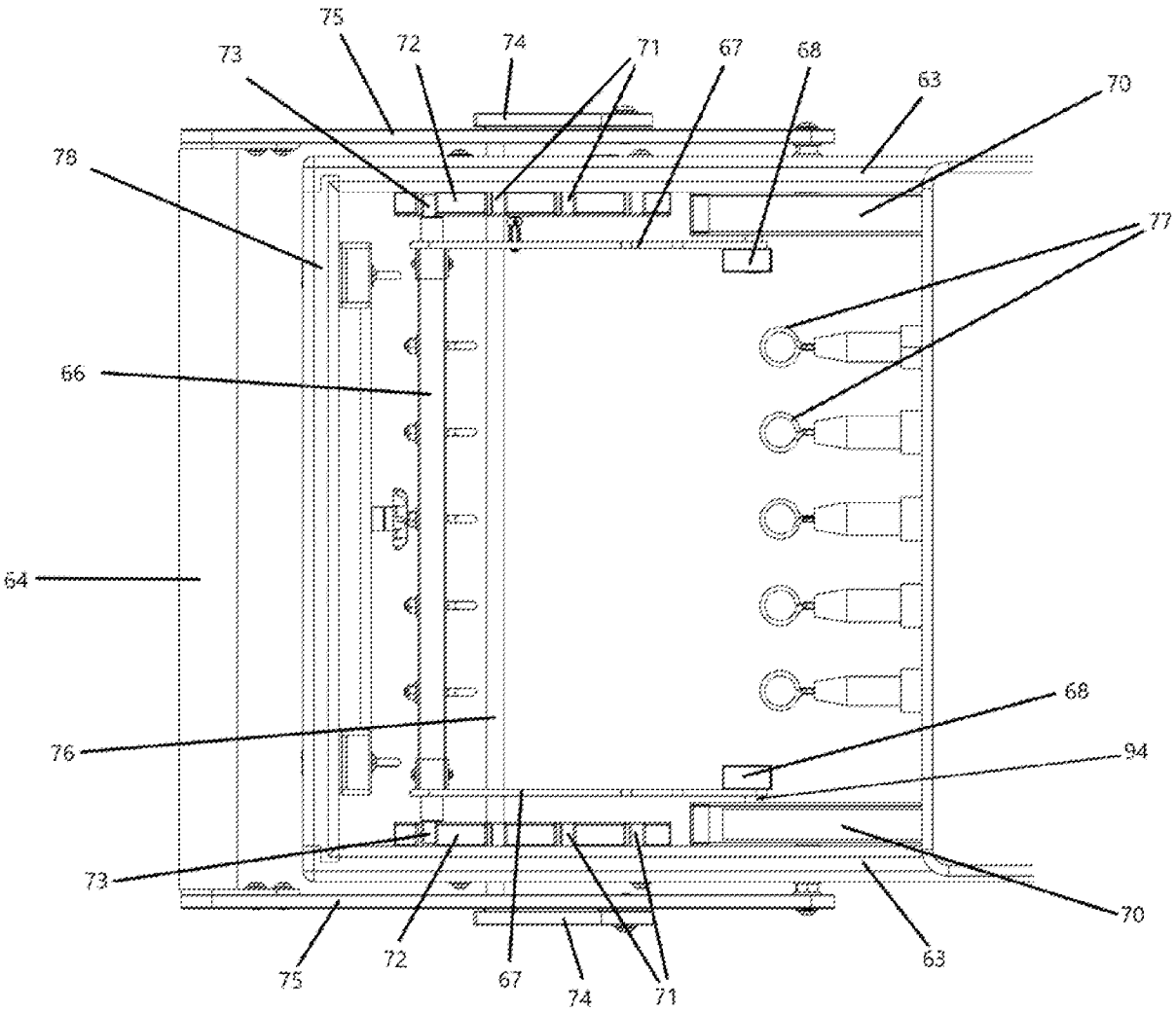
FIG. 7 is a top view of the foot end of an exercise apparatus in accordance with FIG. 6.
Figure 8:
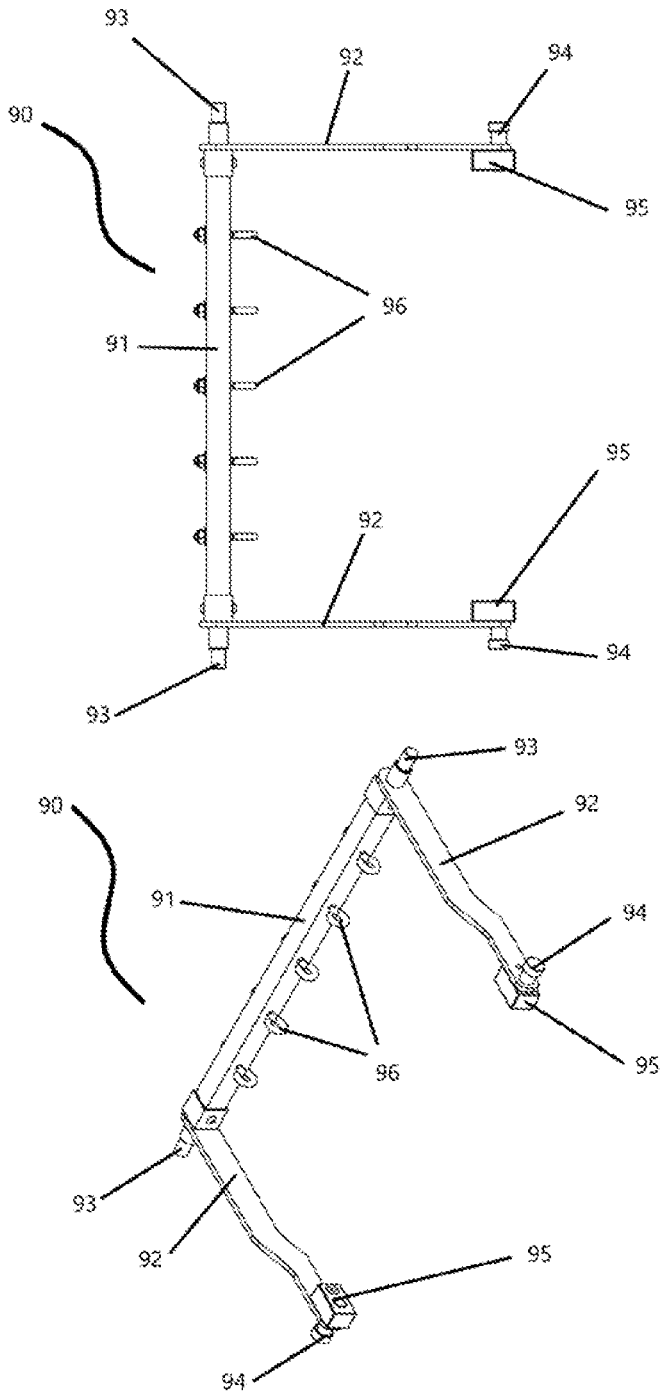
FIG. 8 is a top and perspective view of a movable spring anchor bar and carriage stop assembly for the apparatus of FIGS. 6 and 7.
Figure 11:
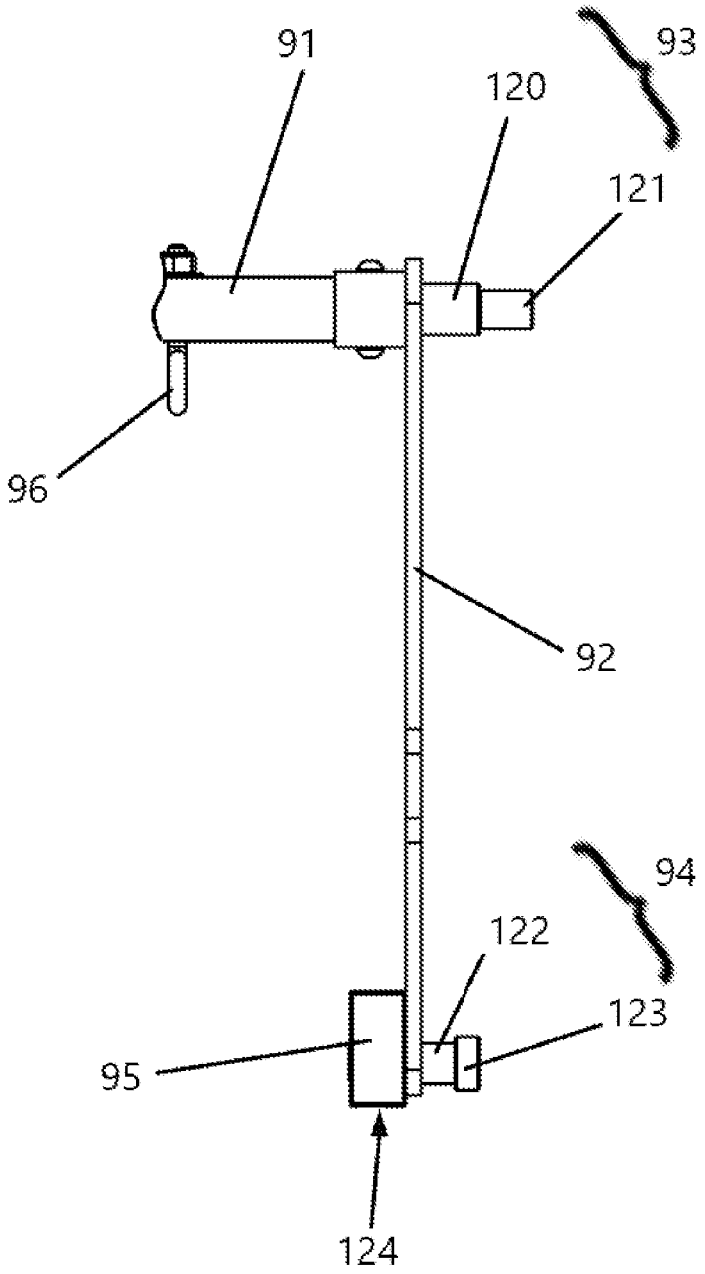
FIG. 11 is an enlarged portion of the top view of the movable spring anchor bar and carriage stop assembly as shown in FIG. 8.

With reference to FIG. 6, an exercise apparatus (60) is shown, which incorporates a pin (94, not shown) and low friction slot or guide (69) arrangement as the movable engagement means. Illustrated are inter alia the carriage (61), shoulder stops (62) the side frame (63), the foot bar assembly (64 and 65), the anchor bar (66), the elongated stop member (67), the stop surface member (68) and a low friction polymer lined slot (69) located within the side frame (63) and anchor bar support (72), which is secured to the side frame (63). This is illustrated in greater detail in FIGS. 6-B and 7, which show the apparatus (70) with footrest assembly (64, 74, 75 and 76) anchor bar of square cross-section (66) with end pins (73), elongated stop member (67) and stop surface member (68) and springs (77). A pin (94) attached to or passing through the elongated stop member (67) movably engages within the slot (69). The anchor bar assembly (90) for this apparatus is further illustrated in FIGS. 8 and 11, in which is shown an anchor bar (91), having end pins (93) for engagement with an anchor bar support (72, not shown) and spring anchors (96), the anchor bar (91) having two elongated stop members (92) and two stop surface members (95) at the ends of the elongated stop members (92) remote from the anchor bar (91). Also show are the pins or axles (94) adjacent the stop surface members (95); these pins engage within and rotate and slide within the slots (69) of the apparatus. During use the elongated stop members (92) and stop surface members (95) are able to pivot about the axis of these pins (94) but are constrained from any other movement other than to move with these pins (94) as they rotate and/or slide within the low friction slots (69). As shown in FIG. 11, the end pins (93) have two sections (120, 121); the first section (120) proximate to the elongated stop member (92) is of larger dimension than the second section (121), which is of the correct dimensions to sit comfortably within the slots (71) of the anchor bar support (72). The larger dimension of section (120) ensures that there is minimum lateral movement of the anchor bar (91) when the end pins (93) are located within the slots (71) and at the same time ensures that the sides of the elongated stop members (67,92) do not come into contact with the apparatus frame (63) and anchor bar support (72) during use. The movable engagement means in the form of a pin (94) comprises two sections (122, 123). The first section (122), which is proximate to the outer surface of the elongated stop member (67,92) sits comfortably within the low friction slot (69) of the apparatus (60), whilst the outer section (123), which is in the form of a flange sits within the interior of the side frame (63) and prevents the lateral movement of the pin (94) from engagement within the low friction slot (69). This arrangement ensures that when the anchor bar (91) is disengaged from the anchor bar support (71,72) that the elongated stop members (67,92) are held rigidly in position relative to and remain engaged with the side frame (63) but may pivot freely about the pins (94) and the whole anchor bar assembly may then be moved to a new slot (71) location in the anchor bar support (72) as the pin (94) slides freely within the constraints of the low friction slot or guide (69). The stop surface (124) of the stop surface members (95) is also illustrated.

Figure 9:
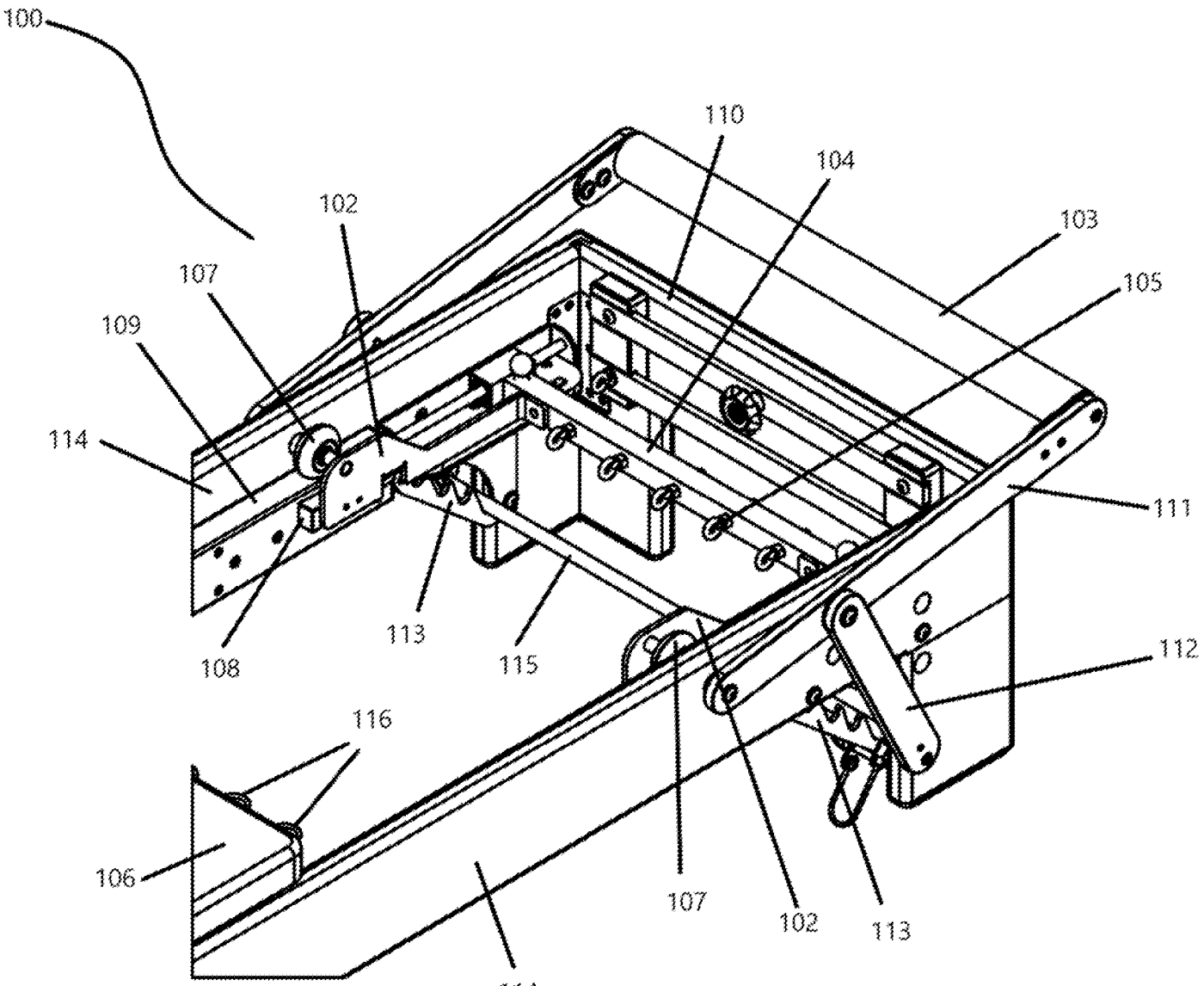
FIG. 9 is a perspective view of the foot end of an exercise apparatus in accordance with one embodiment of the present invention.
Figure 10:
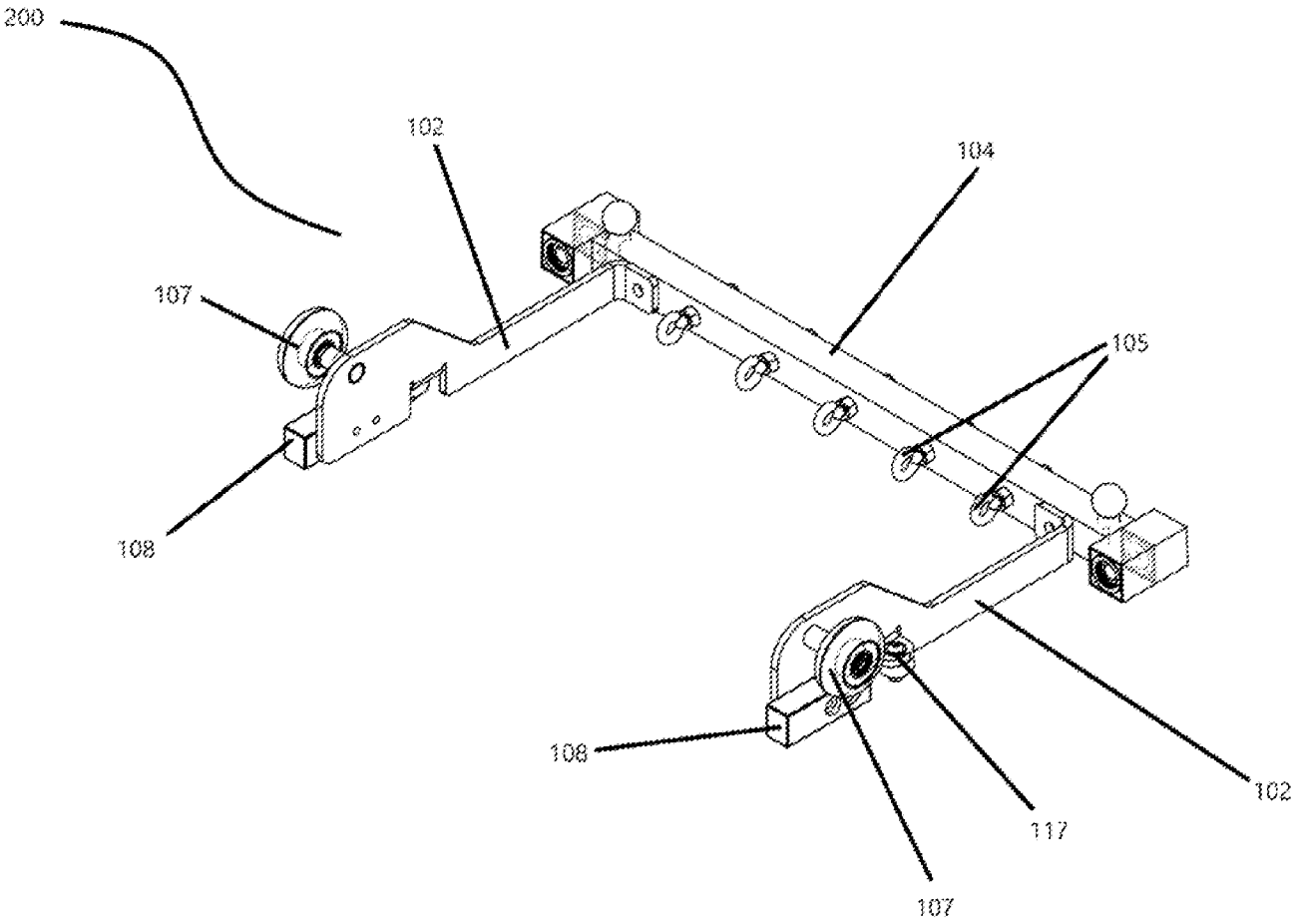
FIG. 10 is a perspective view of a movable spring anchor bar and carriage stop assembly for the apparatus of FIG. 9.

With reference to FIGS. 9 and 10, there is show an apparatus (100) and anchor bar assembly (200) which utilize a top surface track (109), upon which the part of the movable engagement means (107) in the form of a wheel is engaged. Illustrated are the elongated stop members (102), footrest assembly (103, 111, 112, 114 and 115) at the foot end (110) of the apparatus (100), the square-section anchor bar (104), the spring anchors (105), the carriage (106), carriage springs (116), side frame (1141 the stop surface members (108) and aligned wheels (117).

Figure 12:
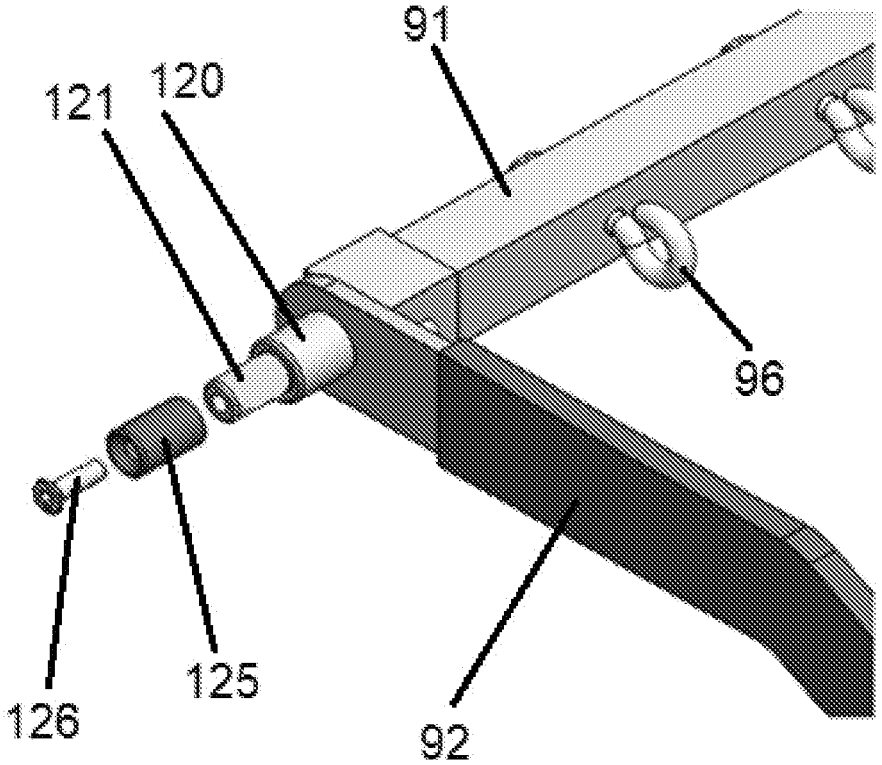
FIG. 12 is a perspective and enlarged portion of the top view of the movable spring anchor bar and carriage stop assembly of FIGS. 8 and 11, showing a rubber sleeve addition.

With reference to FIG. 12, the end pin (93) consisting of engagement first section (120) proximate to the elongated stop member (92) is of larger dimension than the second section (121), which is further modified by the addition of a rubber sleeve (125), which is optionally secured to the end pin (93) by means of a bolt (126). In this embodiment the exterior dimensions of the sleeve (125) are of the correct dimensions to sit comfortably within the slots (71) of the anchor bar support (72), which may be of larger dimensions in this embodiment to accommodate the larger sleeve (125) dimensions. The dimensions of all features these features (71, 93, 120, 121, and 125) may be adjusted to accommodate each other in the final assembly of the apparatus. Also shown are spring anchors (96).

The present invention may be practiced otherwise than as specifically described above. Many changes, alternatives, variations, and equivalents to the various structures shown and described will be apparent to one skilled in the art.

Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

It is understood that any embodiment described herein may be used in combination with one or more of each of the other embodiments and all of these combinations of embodiments are within the scope of the present invention.

All of the features disclosed in this specification for each and every embodiment (including any accompanying claims, abstract and drawings), and/or all of the steps of any method or process so disclosed, may be combined in any combination, except combinations where at least some of such features and/or steps are mutually exclusive.

The invention claimed is:

1. An exercise apparatus comprising:

a movable carriage having a generally flat top surface, the movable carriage being movably mounted on parallel track members of a frame having a head end, a foot end and side members, the movable carriage having a pair of shoulder stops mounted thereto and a plurality of elastic members connected between the foot end and the movable carriage to elastically bias the movable carriage toward the foot end of the frame, and a movable spring anchor bar and carriage stop assembly comprising an anchor bar with an associated anchor bar support for engagement with the anchor bar, the anchor bar having at least one elongated stop member arranged perpendicular to and secured to the anchor bar, the at least one elongated stop member having a carriage stop surface located towards an end of the at least one elongated stop member remote from the anchor bar and the at least one elongated stop member further comprising at least one movable means of engagement, engaged with the side members of the exercise apparatus and the at least one elongated stop member, at a pivot point about an axis perpendicular to the side members of the exercise apparatus that are proximate to the carriage stop surface, said pivot point being remote from and separate from the location of the anchor bar on the at least one elongated stop member.

2. The exercise apparatus as claimed in claim 1, wherein the movable spring anchor bar and carriage stop assembly comprises two elongated stop members.

3. The exercise apparatus as claimed in claim 1, wherein the carriage stop surface is located at the end of the at least one elongated stop member.

4. The exercise apparatus as claimed in claim 1, wherein the at least one elongated stop member comprises a stop surface member secured at its end.

5. The exercise apparatus as claimed in claim 4, wherein the stop surface member comprises an elastomeric or polymeric material.

6. The exercise apparatus as claimed in claim 4, wherein the stop surface member is located between the end of the at least one elongated stop member and the at least one movable means of engagement.

7. The exercise apparatus as claimed in claim 4, wherein the end of the at least one elongated stop member is located between the stop surface member and the at least one movable means of engagement.

8. The exercise apparatus as claimed in claim 4, wherein the stop surface member comprises a metal or a low friction material.

9. The exercise apparatus as claimed in claim 1, wherein the at least one movable means of engagement is a vertical wheel riding within a C-section runner along the side of or within the side members.

10. The exercise apparatus as claimed in claim 1, wherein the side member is a C-section frame.

11. The exercise apparatus as claimed in claim 1, wherein the at least one movable means of engagement is a vertical wheel combined with a horizontal wheel both riding within a square section runner along the side of or within the side members.

12. The exercise apparatus as claimed in claim 1, wherein the side member is a square section frame.

13. The exercise apparatus as claimed in claim 1, wherein the at least one movable means of engagement comprises a slot in the side member and an axle engaged with said slot that protrudes from the side of the at least one elongated stop member.

14. The exercise apparatus as claimed in claim 13, wherein the axle is an integral part of a stop surface member secured at the end of the at least one elongated stop member.

15. The exercise apparatus as claimed in claim 14, wherein the integral part of the stop surface member as the axle passes through the at least one elongated stop member to engage with the slot.

16. The exercise apparatus as claimed in claim 13, wherein the slot is located in a metal plate or section that is attached to or within the side members of the apparatus.

17. The exercise apparatus as claimed in claim 13, wherein the slot comprises low friction material.

18. The exercise apparatus as claimed in claim 1, wherein the at least one movable means of engagement comprises a low friction material slidably engaged within the side members of the apparatus.

19. The exercise apparatus as claimed in claim 17, wherein the low friction material is friction polymeric material.

* * * * *